United States Patent [19]

Hildebrandt et al.

[11] 4,296,981

[45] Oct. 27, 1981

[54] DESK WITH A CHANNEL FOR RECEIVING CABLES, WIRES ETC.

[76] Inventors: Norbert Hildebrandt, Grüner Winkel 32, 4782 Erwitte 1; Norbert Becker, Weringhauser Str. 15, 4782 Erwitte 2; Rolf Walter, Jägergasse 1, 6302 Lich 4; Manfred Hoffman, Bahnhofstrasse 23, 6305 Grossen Buseck I, all of Fed. Rep. of Germany

[21] Appl. No.: 87,179

[22] Filed: Oct. 22, 1979

[30] Foreign Application Priority Data

Oct. 21, 1978 [DE] Fed. Rep. of Germany ..... 7831436

[51] Int. Cl.[3] ..... A47B 13/02; A47B 77/08

[52] U.S. Cl. ..... 312/194; 312/223

[58] Field of Search ..... 312/194–196, 312/223, 214

[56] References Cited

U.S. PATENT DOCUMENTS 3,346,311 10/1967 Bears ..... 312/195

3,922,045 11/1975 Meyer ..... 312/195

4,094,256 6/1978 Halper et al. ..... 312/194

FOREIGN PATENT DOCUMENTS 2610939 3/1976 Fed. Rep. of Germany ..... 312/194

2716941 10/1978 Fed. Rep. of Germany ..... 312/194

*Primary Examiner*—Victor N. Sakran

*Attorney, Agent, or Firm*—Blanchard, Flynn, Thiel, Boutell & Tanis

[57] ABSTRACT

A desk with a channel which extends directly below the table top on the backside thereof and which is removably guided in the desk. The channel has a U or L-shaped profile for receiving cables and wires therein. The outer leg of the profile is in alignment, in the retracted condition thereof, with the desk wall and has openings for facilitating an exiting of the cables and wires therethrough. At least on one side of the channel which extends parallel to the table top there is secured a further channel extending perpendicularly to the channel and which extends downwardly. This further channel together with the first channel is movable and can be moved into a recess in a base of the desk and has a connection to the horizontally extending channel.

13 Claims, 10 Drawing Figures

DESK WITH A CHANNEL FOR RECEIVING CABLES, WIRES ETC.

FIELD OF THE INVENTION

The invention relates to a desk with a channel which extends directly beneath the table top on the backside of the desk, which can be removed and is guided in the desk, comprising a U or L-shaped profile for receiving cables and wires therein, the outer leg of which is in pulled-in condition in alignment with the desk wall and has openings for facilitating an exiting of the cables and wires therethrough.

BACKGROUND OF THE INVENTION

Desks with channels for receiving cables and wires therein are known in various constructions. In one conventional desk, the channel is placed into the table top and is either covered with a plate or, however, is accessible through a slot. Furthermore, it is known to arrange the cable channel beneath the table top at its rear side, wherein the accessibility of the cable channel is achieved by the table top being moved as a whole. The movable construction of the table top requires, however, a large manufacturing expense. Furthermore it is known to arrange the cable channel extendably on the rear side of the desk, so that the cables can be placed from above into said channel. The cables are guided out through slots which are arranged in the vertical wall of the cable channel. The last-mentioned construction has the disadvantage that the feeding of the wires to the horizontally lying cable channel is not solved.

The basic purpose of the invention is to provide a desk of the above-mentioned type with a channel for receiving the wires and cables therein so that on the one hand the introduction of the wires and cables which come from a floor plug into the horizontal channel is possible in a simple manner and without a great expense and that on the other hand the cable channel is arranged and constructed in the desk in such a manner that a jamming of the same during pulling out is surely avoided and an interlinking of several side-by-side positioned desks is possible.

This purpose is inventively attained by securing at least on one side of the channel extending parallel with respect to the table top, a downwardly extending further channel, which extends perpendicularly with respect to said first channel, which further channel is movable together with the first channel and can be moved into a recess of the side wall or the base of the desk and has a connection to the horizontally extending channel. The horizontally extending and the vertically extending channels, which are arranged in the side walls, form one unit, so that, when these are pulled out, the cables or wires can be inserted into the exposed cable channels. Thus the cable can in one operation be placed effortlessly into the vertical and horizontal channel. After moving these channels into the back wall of the desk or into the side walls or the base, the wires are covered, so that neither the aesthetic appearance of the desk is influenced nor the risk of an accident due to the occurrence of loose cables lying on the floor or hanging down from the desk onto the floor.

According to a preferable embodiment of the invention, the horizontally extending channel and the vertically extending channel or channels are connected flexibly. This makes it possible that the cable channel needs to be pulled out only at the side wall or the base from its guideway, on which side wall the cable is to be inserted.

To divide the cable channel into several compartments, as it is needed, for example, for the separation of low-voltage and high-voltage current, the invention suggests to insert an extruded profile into the cable channel. This extruded profile is constructed preferably both in the vertical and also horizontal channel in one piece and is produced of a flexible material. The channels are secured on the extruded profile, so that between the vertical channels and the horizontal channel, a flexible connection can be obtained in a simple manner.

According to a further exemplary embodiment of the invention a horizontal channel is provided with a guideway at least on its two ends, which guideway permits a pulling of the channel completely out at one side, while the other side of the channel still remains in the desk.

BRIEF DESCRIPTION OF THE DRAWINGS

One exemplary embodiment of the invention is described in more detail hereinafter with reference to the drawings, in which.

DETAILED DESCRIPTION

Figure 1:
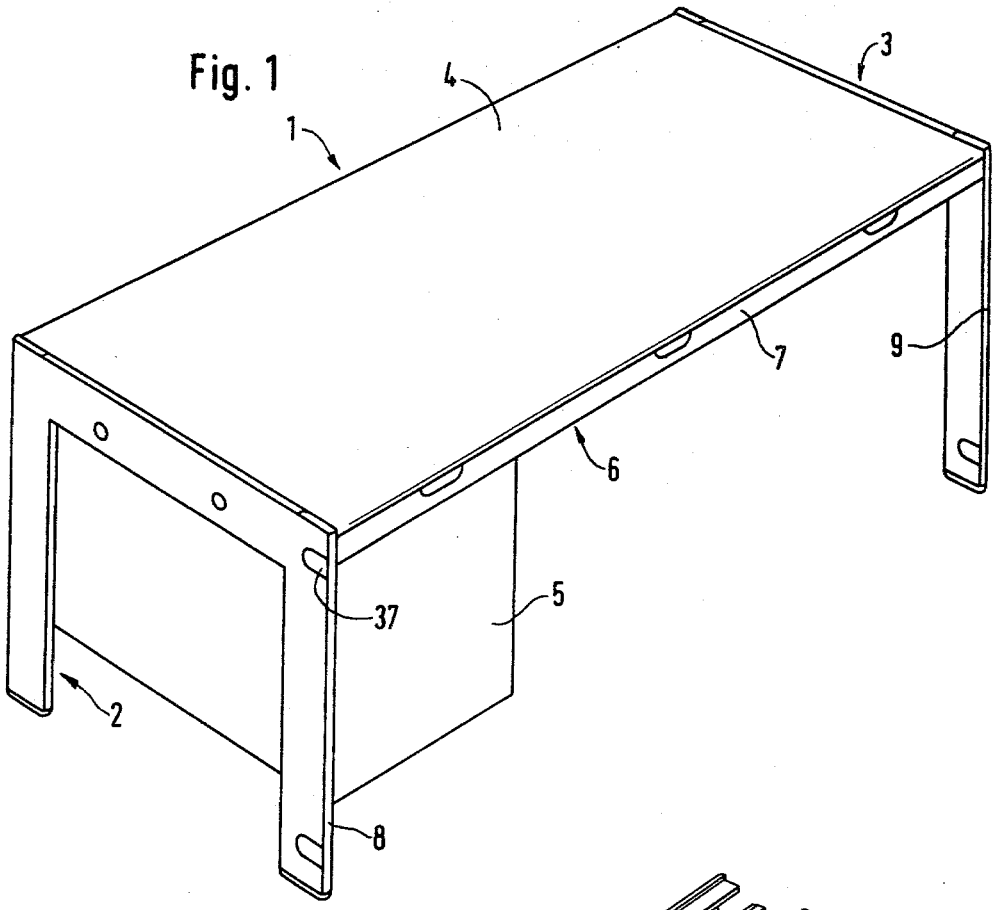
FIG. 1 is a perspective view of the backside of a desk with an inventively constructed channel.

FIG. 1 illustrates the back view of a desk 1 in a perspective view. The desk 1 has a pair of laterally spaced bases 2,3, to which the table top 4 and the cabinet 5 are secured. A channel 6 is mounted below the table top, which, as can be seen from FIG. 2, can be pulled out from the desk.

Figure 3:
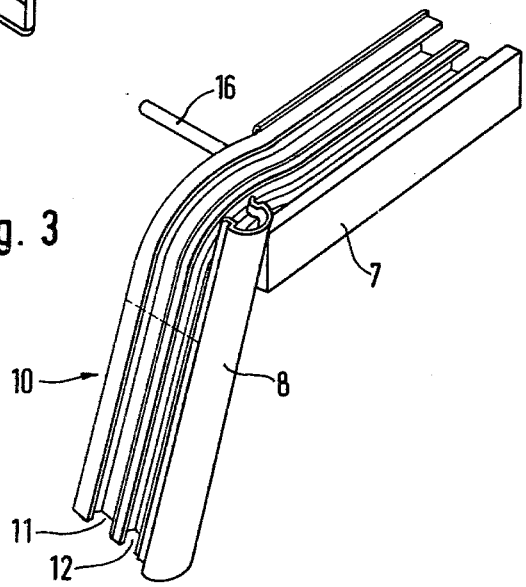
FIG. 3 illustrates a detail of the channel.

The channel 6 is formed by a horizontally extending channel 7 and two laterally spaced, vertically extending channels 8 and 9. The horizontal channel and the two vertical channels are elastically connected, as it is shown in FIG. 3. The elastic connection is achieved by inserting into the channels 7 to 9 an extruded profile 10 which divides the channels into several sections 11 and 12. The extruded profile is made of a flexible material and is secured in the channels 7 and 8 or 7 and 9. This extruded profile permits a canting of the channels 7 and 8 or 7 and 9, as this is illustrated in FIG. 3. Through this, it is possible to pull out only one side, for example, the channel 8 from the base 2.

Figure 4:
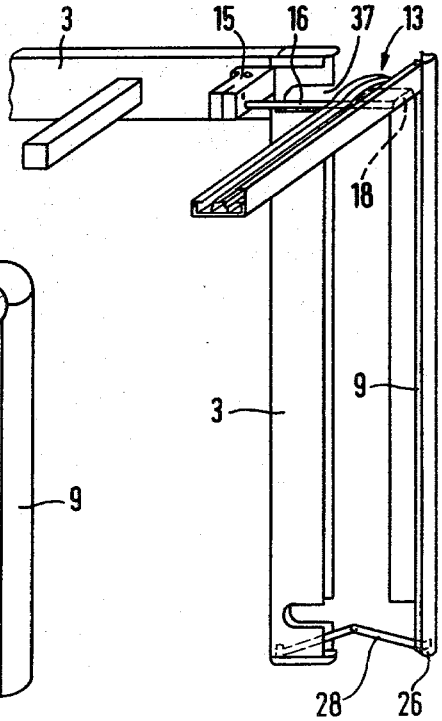
FIG. 4 illustrates the channel of FIG. 2, partially in cross section with the table top removed.
Figure 8:
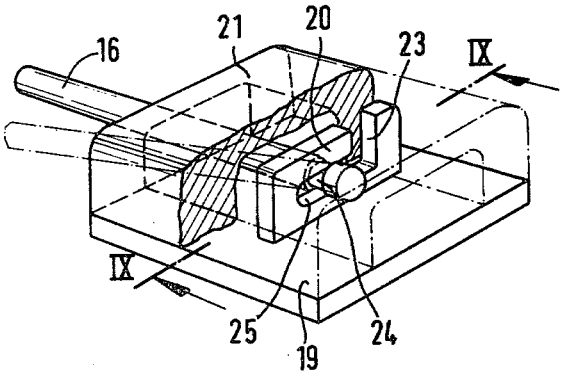
Figure 9:
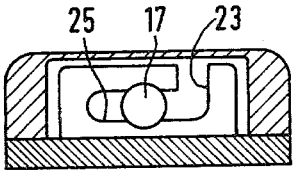
Figure 10:
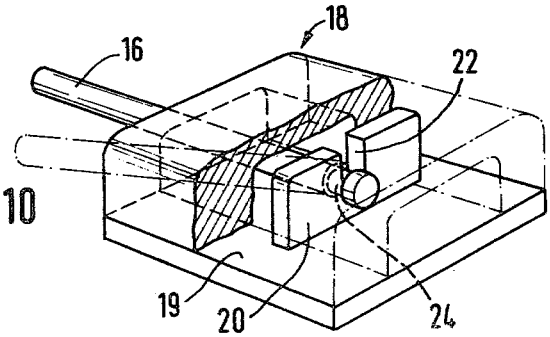

The design and operation of the cable channel can be recognized from FIG. 4. A guideway 13,14 is provided in each of the two ends of the channel 7, which guides the channel 6 during a pulling out from the desk 1 and limits the amount of pulling-out movement. Through this, it is achieved that the channel is held also in the pulled-out condition, so that the cables or wires can be inserted without any effort into said channel. The guideway 13 consists of a sleeve 15 having an opening therethrough, which is secured to the base 2 or 3 and receives a rod 16 therein, which rod is slidably received in the opening. The rod 16 is secured at its front end 17 in a mounting 18, which is illustrated in FIGS. 8 to 10. The mounting 18 consists of a base plate 19, in which is secured a web 20 having recesses 22 (FIG. 10) or 23. A cover plate 21 is placed over the web and the base plate 19. The front end of the rod 16 has an annular groove therein, the dimension of the center part being slightly less than the width of the recesses 22,23. The cover plate 21 prevents the end 17 of the rod 16 from sliding out of the recesses 22 or 23.

The recess 22 consists of a vertical slot in the web 20, while the recess 23 includes a further horizontal slot 25 connected to the vertical slot and permits a movement of the end of the rod relative to the mounting 18 in the horizontal direction. Through this construction of the mounting 18, it is possible to only pull out the side of the channel 6, into which cable is to be laid. Furthermore this construction of the mounting prevents with certainty a canting of the very long channel 6 during pulling out.

Figure 7:
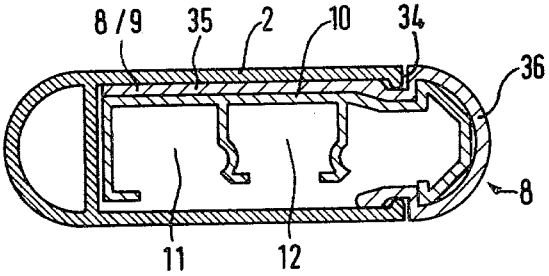
FIG. 7 is a cross-sectional view taken along the line VII—VII of FIG. 2, and FIGS. 8 to 10 are partial cross-sectional views of the guide elements of the channel in the table.

The lower end of the two channels 8,9, which can be moved into a recess in the base 2, as this is illustrated in FIG. 7, are connected through their lower ends 26,27 by a scissorlike linkage arrangement 28 (FIG. 4) in the base. The advantage of this arrangement consists in the channel 6 having also in a fully extended condition a sufficient rigidity for inserting the cables and wires.

Figure 5:
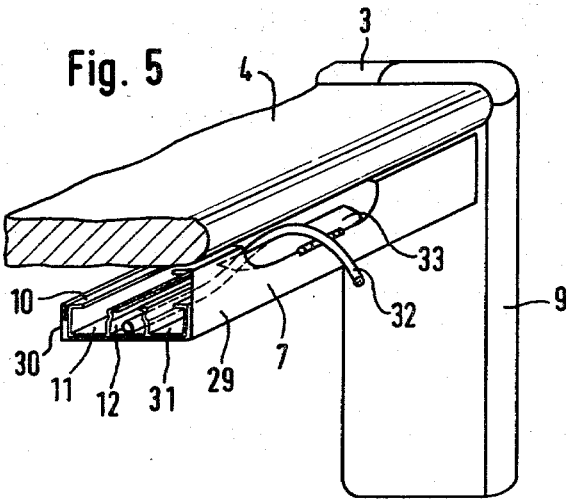
FIGS. 5 and 6 illustrate two different embodiments of the channel for receiving the cable.
Figure 6:
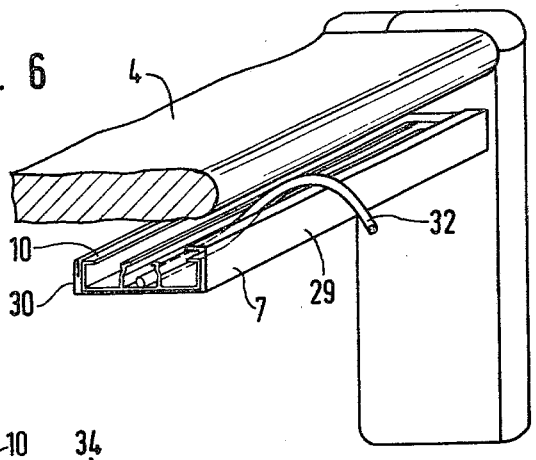

In FIGS. 5 to 7, which show the channel 7 or 8 in a cross-sectional view, the design of the channel can clearly be recognized. The channel consists of a U-profile having an outer higher leg 29 and a lower constructed leg 30 which lies on the inside of the outer leg. The inner leg 30 has approximately the same height as the extruded profile 10 which divides the channel 7 into three sections 11,12 and 31. Through this, one achieves in a simple manner the necessary separation for the low and high current wires and possibly lines for supplying further media, for example, for air conditioning.

Figure 2:
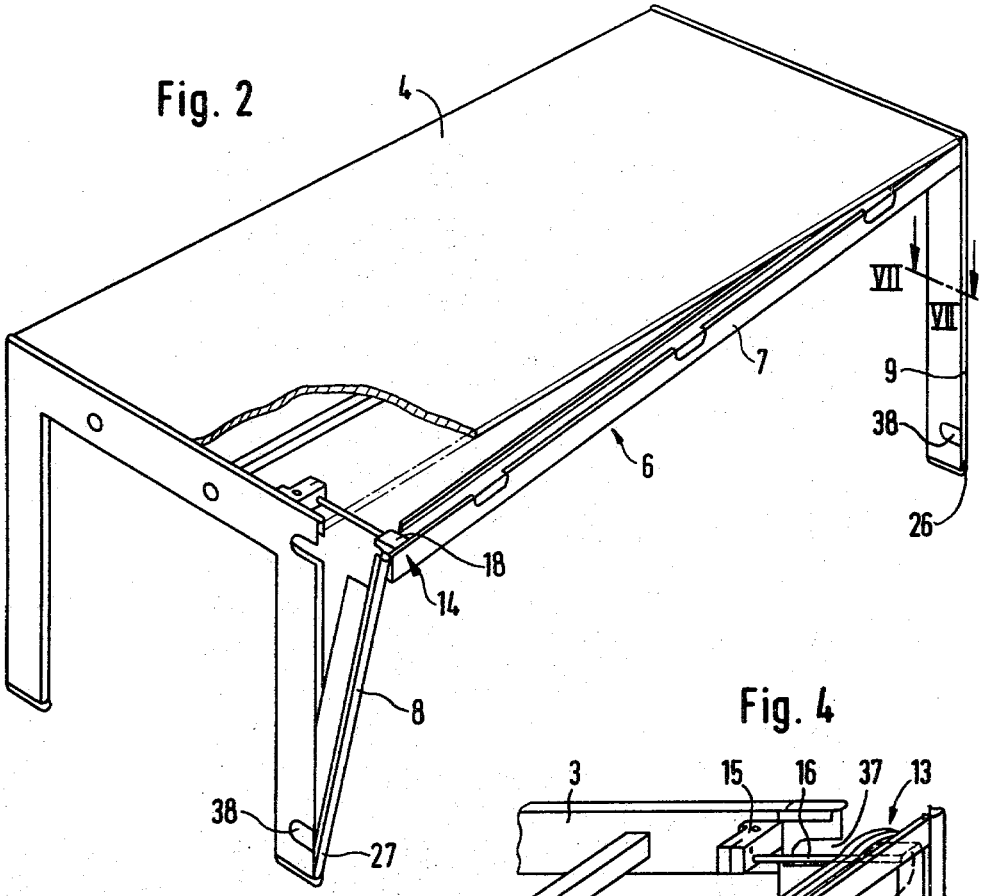
FIG. 2 illustrates a desk with a partially pulled-out channel.

FIGS. 5 and 6 show different embodiments for guiding the cables 32 which exit from the extruded profile. In the exemplary embodiment according to FIG. 6, the height of the leg 29 is limited so that a sufficient spacing exists between the table top 4 and the channel 7 for guiding the wires 32 therebetween. However, in the exemplary embodiment according to FIG. 5, the upper extent of the leg 29 is oriented directly below the table plate 4. Pivotally supported flaps 33, which are provided with return springs, are provided for covering an opening through which is guided the cables 32, which flaps 33, if no cable is to be guided to the outside, closes off the opening due to the biassing of the return springs, as this is illustrated in FIGS. 1 and 2.

FIG. 7 illustrates the design of the vertically extending part of the base 2 or 3. The base 2 has on its front side 34 an opening, into which the channel 8,9 is moved. The channel consists of a straight leg 35 and a part 36 which forms a rounded cap. The extruded profile 10 is inserted into the channels 8,9, which extruded profile divides in a conventional manner the channel into several sections 11,12 and 31 for receiving the different wires.

Openings 37 are provided in the side walls 2,3 as an extension of the horizontal channel 7, which openings pass over into the channel 7. These openings 37 are used to permit a linking together of several desks which are positioned with their front side side-by-side. These openings permit a guiding of the cables directly from one channel 7 of one desk into the adjacent channel of a different desk, without necessitating a guiding of the cables first through the base downwardly and then again upwardly. Furthermore, further openings 38 are provided in the lower area of the base, through which the cables can be introduced into the base. Both the openings 37 and also the openings 38 are, if they are not used, covered with flaps.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a desk having a first channel which extends directly below and parallel to the table top of the desk at the back side of the desk, which channel can be pulled out from and is guided in the desk, which channel is of U- or L-shaped cross section for receiving cables and wires, the outer leg of which channel is in alignment, in its retracted condition, with the desk wall and has openings for facilitating an exiting of cables and wires, the improvement comprised in that said first channel opens upwardly and in its retracted condition is closed by said table top, at least on one end of said first channel there is secured a further channel which extends vertically downwardly from the horizontally extending first channel, said further channel being movable with said first channel, said further channel being movable into a recess in a base of the desk, said further channel being open to said horizontally extending first channel, and including webs extending longitudinally in and subdividing both channels.

2. The desk according to claim 1, wherein the horizontally extending channel and the vertically extending channel are connected flexibly to one another.

3. The desk according to claim 1 or 2, wherein the webs are part of an extrusion.

4. The desk according to claim 1, wherein an extruded profile is inserted in the horizontally extending and vertically extending channels, which extruded profile carries said webs to thereby divide said channels into several compartments, said extruded profile extending continuously from one channel into the next.

5. The desk according to claim 1, wherein the vertical and horizontal channels are connected by an extruded profile.

6. The desk according to claim 5, wherein the extruded profile is of a flexible material.

7. The desk according to claim 1, including guide means guiding the lower end of each vertically extending channel in the base of the desk.

8. The desk according to claim 7, wherein said guide means is constructed as scissors.

9. The desk according to claim 1, including a guide element engaging the horizontally extending channel at least on each end of the latter, which guide element receives one end of a guide rod, said guide rod being axially movable in an opening in a sleeve in the desk, said guide element comprising a mounting wherein said one end of the guide rod is horizontally movably held in said mounting.

10. The desk according to claim 1, wherein said cable and wire openings in said outer leg of at least the horizontally extending channel are covered by self-closing flaps.

11. The desk according to claim 10, wherein said flaps are held in their closed position by torsion springs.

12. The desk according to claim 1, wherein openings are provided in the bases and are located as an extension of the horizontally extending channel.

13. The desk according to claim 1, wherein in the lower area of the base there are provided openings for facilitating a feeding of the wires into the channels.

* * * * *